US005716924A

United States Patent [19]

Balaguer et al.

[11] Patent Number: 5,716,924

[45] Date of Patent: Feb. 10, 1998

[54] AQUEOUS BLEACHING FORMULATIONS

[75] Inventors: Angeles Balaguer, Caldes de Montbut; Jaume Josa, Terrassa; Mercedes Mendoza; Miguel Osset, both of Barcelona, all of Spain

[73] Assignee: Henkel Kommanditgesellschaft auf Aktien, Duesseldorf, Germany

[21] Appl. No.: 569,120

[22] PCT Filed: Apr. 10, 1995

[86] PCT No.: PCT/EP95/01304

§ 371 Date: Feb. 22, 1996

§ 102(e) Date: Feb. 22, 1996

[87] PCT Pub. No.: WO95/28470

PCT Pub. Date: Oct. 26, 1995

[30] Foreign Application Priority Data

Apr. 18, 1994 [DE] Germany ..... 44 13 433.9

[51] Int. Cl.[6] ..... C11D 3/39; C11D 1/83

[52] U.S. Cl. ..... 510/336; 510/372; 510/424; 510/426; 510/383

[58] Field of Search ..... 310/370, 372, 310/375, 383, 336; 510/424, 426

[56] References Cited

U.S. PATENT DOCUMENTS

| | | | |
|---|---|---|---|
| 4,656,043 | 4/1987 | Hawkins et al. | 424/70 |
| 5,034,159 | 7/1991 | Tesmann et al. | 252/511 |
| 5,271,860 | 12/1993 | Schwadtke et al. | 252/96 |
| 5,500,151 | 3/1996 | Cao et al. | 252/546 |

FOREIGN PATENT DOCUMENTS

| | | |
|---|---|---|
| 0376704 | 7/1990 | European Pat. Off. . |
| 0431747 | 6/1991 | European Pat. Off. . |
| 0484095 | 5/1992 | European Pat. Off. . |
| 3817415 | 11/1989 | Germany . |
| 4117972 | 12/1992 | Germany . |
| 4140181 | 6/1993 | Germany . |
| 3091597 | 4/1991 | Japan . |
| WO9202607 | 2/1992 | WIPO . |
| WO9509226 | 4/1995 | WIPO . |

OTHER PUBLICATIONS

J.Am.Oil.Chem.Soc. 67, pp. 599–604 (1990) (Sep.).
Seifen–Oele–Fette–Wachse, 117, 592 (1991) Sep.

*Primary Examiner*—Margaret Einsmann
*Attorney, Agent, or Firm*—Ernest G. Szoke; Wayne C. Jaeschke; Real J. Grandmaison

[57] ABSTRACT

The invention relates to new aqueous bleaching formulations containing 1 to 10% by weight of peroxide compounds, 1 to 2.5% by weight of fatty alcohol ether sulfates 0.4 to 1.0% by weight of narrow-range fatty alcohol polyglycol ethers and 1 to 2.5% by weight of electrolytes.

The formulations are distinguished by advantageous viscosity, a cloud point of at least 20° C. and high stability in storage.

4 Claims, No Drawings

AQUEOUS BLEACHING FORMULATIONS

BACKGROUND OF THE INVENTION

1. Field of the Invention

This invention relates to aqueous bleaching formulations containing peroxide compounds, fatty alcohol ether sulfates, narrow-range fatty alcohol polyglycol ethers and electrolytes.

2. Discussion of Related Art

In the past, bleaching formulations based on hydrogen peroxide which show remarkable viscosity and, accordingly, are suitable both for treating horizontal surfaces and for treating sloping and, above all, vertical surfaces have been successfully used in the fields of hygiene and disinfection. The effect of the viscosity of these bleaching formulations is that the contact time between the bleaching formulation and the surface to be treated is considerably longer than in the case of commercial liquid products which quickly flow off from the surface.

Accordingly, there has been no shortage of attempts to provide viscous bleaching formulations of the type in question. Spanish patent application ES 88/1389 (Henkel Iberica), for example, proposes aqueous bleaching and disinfecting formulations based on alkali metal hypochlorites which are thickened by addition of fatty alcohol ether sulfates. However, ether sulfates are unsuitable on their own for adjusting the viscosity of bleaching formulations containing hydrogen peroxide. They give products of very low viscosity which turn cloudy at low temperatures and are not sufficiently stable in storage.

Accordingly, the problem addressed by the present invention was to provide new bleaching formulations containing peroxide compounds which would have an advantageous viscosity of at least 100 mPa.s, a cloud point of at least 20° C. and high stability in storage.

DESCRIPTION OF THE INVENTION

The present invention relates to aqueous bleaching formulations containing 1 to 10% by weight of peroxide compounds, 1 to 2.5% by weight of fatty alcohol ether sulfates 0.4 to 1.0% by weight of narrow-range fatty alcohol polyglycol ethers and 1 to 2.5% by weight of electrolytes.

It has surprisingly been found that the addition of fatty alcohol ether sulfates, fatty alcohol polyglycol ethers and electrolyte salts in selected quantity ratios leads to excellent thickening of aqueous hydrogen peroxide solutions. The products obtained are extremely stable in storage both in regard to their viscosity and in regard to their peroxide content and have a cloud point of at least 20° C.

Peroxide Compounds

Peroxide compounds in the context of the present invention are understood to be substances containing an O—O group. Typical examples are perborates, percarbonates, percarboxylic acids and, in particular, hydrogen peroxide. In a preferred embodiment, the aqueous bleaching formulations according to the invention contain hydrogen peroxide in quantities of 1 to 10% by weight, preferably 5 to 8% by weight and more preferably 6 to 7% by weight, based on 100% of active substance. The peroxide compounds are used, for example, in the form of a 35% by weight aqueous solution.

Fatty Alcohol Ether Sulfates

Fatty alcohol ether sulfates ("ether sulfates") are known anionic surfactants which are industrially produced by the sulfation of fatty alcohol polyglycol ethers with $SO_3$ or CSA and subsequent neutralization.

According to the invention, suitable ether sulfates correspond to formula (I):

$$R^1O—(CH_2CH_2O)_mSO_3X \quad (I)$$

in which $R^1$ is a linear or branched alkyl and/or alkenyl radical containing 6 to 22 carbon atoms, m is a number of 1 to 10 and X is an alkali metal and/or alkaline earth metal, ammonium, alkylammonium, alkanolammonium or glucammonium.

Typical examples are the sulfates of adducts of on average 1 to 10 and, more particularly, 2 to 5 moles of ethylene oxide with caproic alcohol, caprylic alcohol, 2-ethylhexyl alcohol, capric alcohol, lauryl alcohol, isotridecyl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol and erucyl alcohol and technical mixtures thereof in the form of their sodium and/or magnesium salts. The ether sulfates may have both a conventional homolog distribution and a narrow homolog distribution.

It is particularly preferred to use ether sulfates based on adducts of, on average, 2 to 3 moles of ethylene oxide with technical $C_{12/14}$ or $C_{12/18}$ cocofatty alcohol fractions in the form of their sodium and/or magnesium salts.

NRE Fatty Alcohol Polyglycol Ethers

Fatty alcohol polyglycol ethers with a narrow homolog distribution, which are also known as narrow-range ethoxylates (NRE), are known nonionic surfactants which are industrially produced, for example, by addition of ethylene oxide onto fatty alcohols in the presence of suitable catalysts (layer compounds which have been calcined or hydrophobicized with fatty acids). Reviews on this subject are presented, for example, by M. Cox in J. Am. Oil. Chem. Soc. 67, 599 (1990) and by H. Hensen et al. in Seifen-Öle-Fette-Wachse, 117, 592 (1991).

According to the invention, suitable ethers correspond to formula (II):

$$R^2O—(CH_2CH_2O)_mH \quad (II)$$

in which $R^2$ is a linear or branched alkyl and/or alkenyl radical containing 6 to 22 carbon atoms, m is a number of 1 to 10.

Typical examples are narrow-range adducts of on average 1 to 10 and, more particularly, 2 to 5 moles of ethylene oxide with caproic alcohol, caprylic alcohol, 2-ethylhexyl alcohol, capric alcohol, lauryl alcohol, isotridecyl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol and erucyl alcohol and the technical mixtures thereof obtained, for example, in the high-pressure hydrogenation of technical methyl esters based on fats and oils or aldehydes from Roelen's oxosynthesis with a narrow homolog distribution.

Narrow-range adducts of, on average, 2 to 5 moles of ethylene oxide with technical $C_{12-18}$ fatty alcohols, such as for example coconut oil, palm oil, palm kernel oil or tallow fatty alcohol, are preferred. The use of such substances as thickeners for cosmetic products, such as hair shampoos for example, is known from DE-A1 38 17 415 (Henkel). They are preferably used in a concentration of 0.7 to 1.0% by weight.

Electrolytes

Suitable electrolyte salts are alkali metal or alkaline earth metal salts of mineral acids and mixtures thereof which are known in principle as auxiliaries for adjusting the viscosity of aqueous surfactant solutions. Typical examples are sodium chloride and/or magnesium chloride.

Auxiliaries and Additives

Suitable auxiliaries and additives are, for example, other peroxide-stable surfactants and hydrotropes such as, for example, alkyl sulfates, alkyl sulfonates, alkyl benzene sulfonates, xylene sulfonates, sarcosinates, taurides, isethionates, sulfosuccinates, ether carboxylic acids, betaines, sugar esters, amine oxides and alkyl oligoglycosides. The sum total of these additional surfactants preferably makes up at most 10% by weight of the total quantity of surfactants in the formulation.

In addition, the bleaching formulations may contain lower alcohols, such as ethanol or isopropyl alcohol, peroxide-stable fragrances, optical brighteners, anti-oxidants, sequestrants, dyes and pigments in total quantities of 0.01 to 0.5% by weight, based on the bleaching formulation. Known peroxide-stable fragrances include, for example, monocyclic and bicyclic monoterpene alcohols and esters thereof with acetic or propionic acid (for example isoborneol, dihydroterpenol, isobornyl acetate, dihydroterpenyl acetate). The optical brighteners may be, for example, the potassium salt of 4,4'-bis-(1,2,3-triazolyl)-(2-)-stilbene-2,2-sulfonic acid which is marketed as Phorwite® BHC 766 and Tinopal CBS-X (Ciba). Examples of suitable antioxidants are ditert.butyl hydroxytoluene (BHT), ditert.butyl hydroxyanisole (BHA), tocopherol (vitamin E), ascorbic acid and ascorbic acid palmitate, optionally in combination with citric acid. Suitable sequestering agents are phosphonic acids or amine oxide phosphonic acids. Finally, suitable colored pigments are inter alia green chlorophthalocyanines (Pigmosol® Green, Hostaphine® Green), yellow Solar Yellow BG 300 (Sandoz) or red Rojo Basazol®.

The bleaching formulations according to the invention are produced by stirring. The product obtained may optionally be decanted or filtered to remove foreign particles and/or agglomerates.

Commercial Applications

The bleaching formulations according to the invention are clear at ambient temperature, are sufficiently thick for application to vertical surfaces and are stable in regard to their viscosity and peroxide content, even when stored for prolonged periods at elevated temperature. They are suitable, for example, for the cleaning and disinfection of hard surfaces, for example in the sanitary field. In one particular embodiment of the invention, the paste-form bleaching formulations are directly applied to fibers for the pretreatment of soiled textiles.

A typical bleaching formulation according to the present invention has the following composition (water to 100% by weight):

7% by weight hydrogen peroxide

2% by weight $C_{12/14}$ fatty alcohol 2EO sulfate sodium salt 0.7% by weight $C_{12/14}$ fatty alcohol 2EO (NRE)

2% by weight sodium chloride

The following Examples are intended to illustrate the invention without limiting it in any way.

EXAMPLES

I. Substances Used

A) Hydrogen peroxide in the form of a 21% by weight aqueous solution

B) $C_{12/14}$ cocofatty alcohol 2EO ether sulfate sodium salt Texapon® N, Henkel KGaA, Düsseldorf/FRG C) Narrow-range $C_{12/14}$ cocofatty alcohol 2EO adduct Arlypon® F, Henkel KGaA, Düsseldorf/FRG The composition of formulations F1 to F3 according to the invention and comparison formulations F4 to F9 are set out in Table 1.

All the formulations contain 0.05% by weight of sequestering agent (Sequion®), 0.01% by weight of BHT, 0.1% by weight of isopropyl alcohol, 0.2% by weight of perfume oil, 0.00035% by weight of dye and water to 100% by weight.

TABLE 1

Formulations used

| F | $c(H_2O_2)$ % by weight | c(FAES) % by weight | c(FAE) % by weight | c(NaCl) % by weight |
|---|---|---|---|---|
| F1 | 7.5 | 2.00 | 0.700 | 2.00 |
| F2 | 7.5 | 2.00 | 0.700 | 2.50 |
| F3 | 7.5 | 2.00 | 0.810 | 2.00 |
| F4 | 7.5 | 2.00 | 0.550 | 2.00 |
| F5 | 7.5 | 2.50 | 0.550 | 2.00 |
| F6 | 7.5 | 2.00 | 0.550 | 2.50 |
| F7 | 7.5 | 2.50 | 0.550 | 2.50 |
| F8 | 7.5 | 2.25 | 0.625 | 2.25 |
| F9 | 7.5 | 2.00 | 0.550 | 2.88 |

Legend:
c = Concentration
FAES = Fatty alcohol ether sulfate
FAE = Fatty alcohol polyglycol ether II. Performance Tests To evaluate performance, the Brookfield viscosity of the formulations (20° C., 20 r.p.m., spindle 1 to 2), their cloud point and the reduction in their peroxide content after storage for 4 weeks and 12 weeks (40° C.) were determined. The results are set out in Table 2.

TABLE 2

Viscosity, cloud point and stability

| Ex. | F | Viscosity mpa · s | Cloud point °C. | $K_2O_2$ [% by weight] 4 w | 12 w |
|---|---|---|---|---|---|
| 1 | F1 | 163 | 20 | 7.5 | 7.5 |
| 2 | F2 | 105 | 20 | 7.5 | 7.5 |
| 3 | F3 | 107 | 25 | 7.5 | 7.5 |
| C1 | F4 | 47 | 1 | 7.4 | 7.3 |
| C2 | F5 | 16 | 0 | 7.4 | 7.3 |
| C3 | F6 | 265 | 1 | 7.4 | 7.2 |
| C4 | F7 | 91 | 0 | 7.4 | 7.3 |
| C5 | F8 | 565 | 1 | 7.4 | 7.3 |
| C6 | F9 | 99 | 1 | 7.4 | 7.3 |

We claim:

1. An aqueous bleaching composition having a viscosity of at least 100 mPa.s at about 20° C. and a cloud point of at least 20° C. consisting essentially of 1 to 10% by weight of a peroxide compound, 1 to 2.5% by weight of a fatty alcohol ether sulfate, 0.7 to 1.0% by weight of a narrow-range fatty alcohol polyglycol ether, and 1 to 2.5% by weight of an electrolyte, selected from the group consisting of sodium chloride and magnesium chloride, based on the weight of said composition.

2. A composition according to claim 1 wherein said narrow-range fatty alcohol polyglycol ether corresponds to formula (II)

$$R^2O—(CH_2CH_2O)_mH \quad (II)$$

in which $R^2$ is a linear or branched alkyl or alkenyl radical containing 6 to 22 carbon atoms, and m is a number of 1 to 10.

3. A composition according to claim 1 wherein said peroxide compound comprises hydrogen peroxide.

4. A composition according to claim 1 wherein said fatty alcohol ether sulfate corresponds to formula (I)

$$R^1O—(CH_2CH_2O)_mSO_3X \quad (I)$$

in which $R^1$ is a linear or branched alkyl or alkenyl radical containing 6 to 22 carbon atoms, m is a number of 1 to 10, and X is an alkali metal or alkaline earth metal, ammonium, alklammonium, alkanolammonium or glucammonium.

* * * * *